United States Patent [19]

Karpisek

[11] Patent Number: 4,807,774

[45] Date of Patent: Feb. 28, 1989

[54] CONTAINER BASE ASSEMBLY

[76] Inventor: Ladislav S. Karpisek, 86 Woodfield Boulevarde, Caringbah, New South Wales, 2229, Australia

[21] Appl. No.: 50,003

[22] PCT Filed: Jul. 16, 1986

[86] PCT No.: PCT/AU86/00197

§ 371 Date: Mar. 23, 1987

§ 102(e) Date: Mar. 23, 1987

[87] PCT Pub. No.: WO87/00508

PCT Pub. Date: Jan. 29, 1987

[30] Foreign Application Priority Data

Jul. 26, 1985 [AU] Australia ..... PH1659

[51] Int. Cl.[4] ..... B65D 7/24

[52] U.S. Cl. ..... 220/6; 220/1.5; 220/4 F

[58] Field of Search ..... 220/6, 7, 4 F, 1.5, 220/69

[56] References Cited

U.S. PATENT DOCUMENTS

| | | | |
|---|---|---|---|
| 3,306,487 | 2/1967 | Gregoire | 220/1.5 |
| 3,628,683 | 12/1971 | Friedrich | 220/6 |
| 3,651,974 | 3/1972 | Barry et al. | 220/69 X |
| 3,655,087 | 4/1972 | Luisada | 220/1.5 |
| 3,809,278 | 5/1974 | Csumrik | 220/4 F |
| 3,874,546 | 4/1975 | Sanders et al. | 220/6 |
| 4,020,967 | 5/1977 | Hammond et al. | 220/1.5 X |
| 4,452,366 | 6/1984 | Nagai et al. | 220/1.5 X |

*Primary Examiner*—Steven M. Pollard

*Attorney, Agent, or Firm*—Edwin D. Schindler

[57] ABSTRACT

A container base assembly has walls (13, 14, 15) and (16) coupled to a base member (1) in a manner allowing them to fold down over the base member (1) and be erected around the base member (1). The walls (13) to (16) are erected sequentially by a part rotational movement followed by a rectilinear movement in which lips at the lower edges of the wall members are entered into a trough (12) in the base member (1). The walls include hook elements which are interlocked when the walls are in the erected condition to provide a continuous wall system around the base member (1).

4 Claims, 5 Drawing Sheets

FIG. 1.
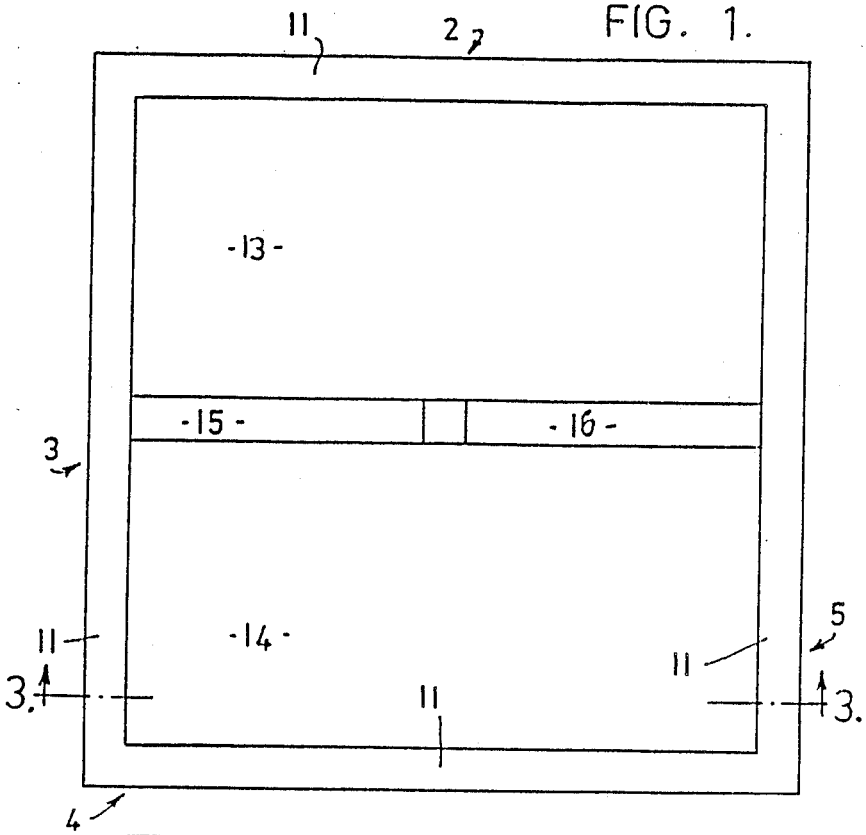
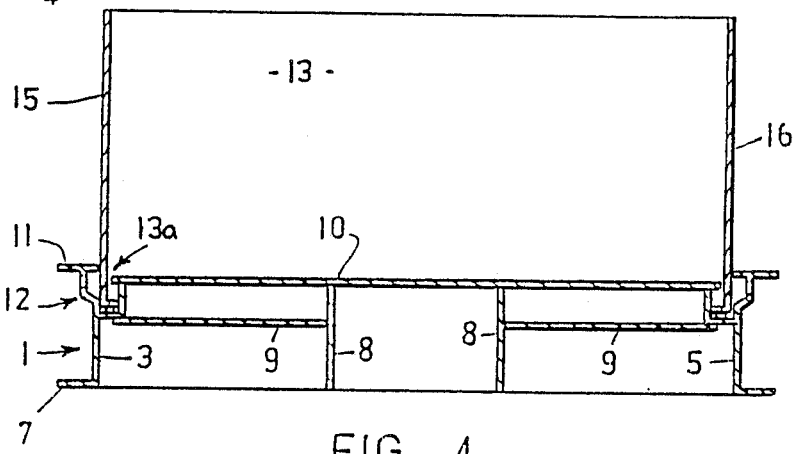
FIG. 4.

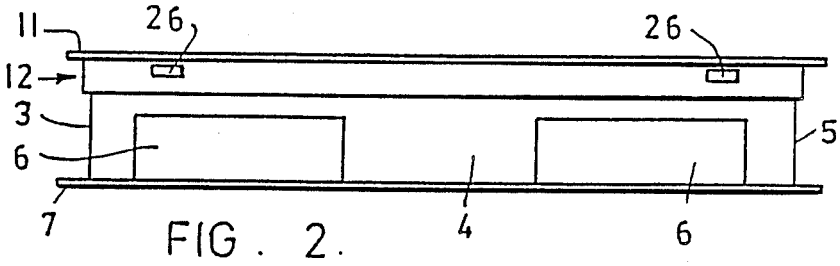
FIG. 2.
FIG. 3.
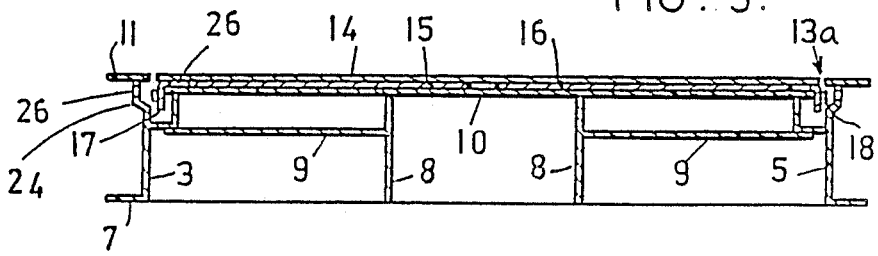
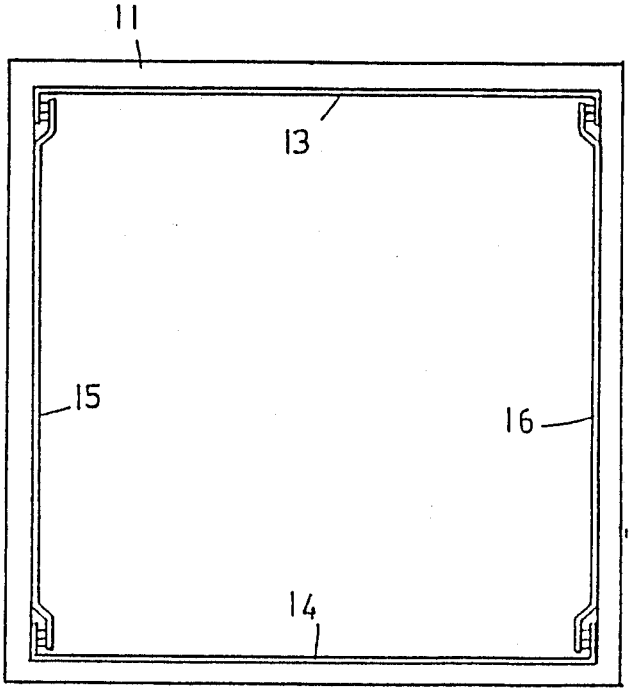
FIG. 12.

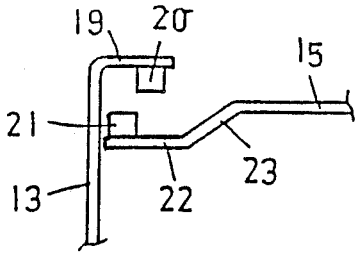
FIG. 7.
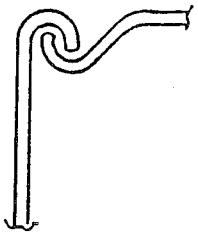
FIG. 8.
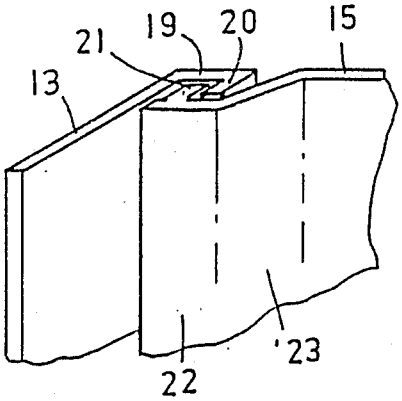
FIG. 9.
FIG. 10.
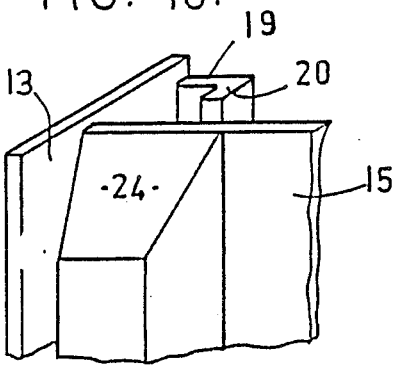
FIG. 11.
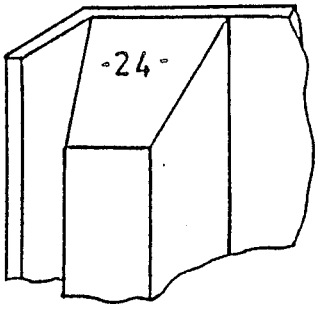

CONTAINER BASE ASSEMBLY

This invention relates containers for the transport of liquids which containers are of the type comprising a base and a number of external walls with a plastic film bag inside the walls to contain liquid. Shock and other loads applied to a filled container of the above type can, when extreme in nature, cause bag rupture. It has been found that ruptures occur most frequently because of the failure of the walls adjacent the base of the container.

This invention has been devised to reinforce the vulnerable zone by providing a container base with several unique features which will overcome at least the type of failure referred to above. The base when combined with external walls in the conventional manner will provide a container for liquids which will withstand very severe operating conditions.

The present invention can be broadly said to comprise a container base assembly comprising a four sided base member and four substantially rectangular wall members with first edges of the wall members respectively permanently coupled to the base member at the four sides thereof in a manner allowing the wall members to be raised to an upright erected condition and to be lowered to a position where they overlie the base member, co-operating positioning means on the base member and on the first edges of the wall members to releasably maintain the wall members in an erected condition and interlocking means along opposed second and third edges of each wall member adjacent the first edge thereof whereby the wall members when erected are interlocked to provide a continuous four sided wall system.

A presently preferred form of the invention will now be described with reference to the accompanying drawings in which:

FIG. 1 is a plan view of the container base when inn a wall folded condition,

FIG. 2 is an elevation from one side of the container base of FIG. 1,

FIG. 3 is a sectional elevation along the section line 3—3 of FIG. 1,

Figure 5:
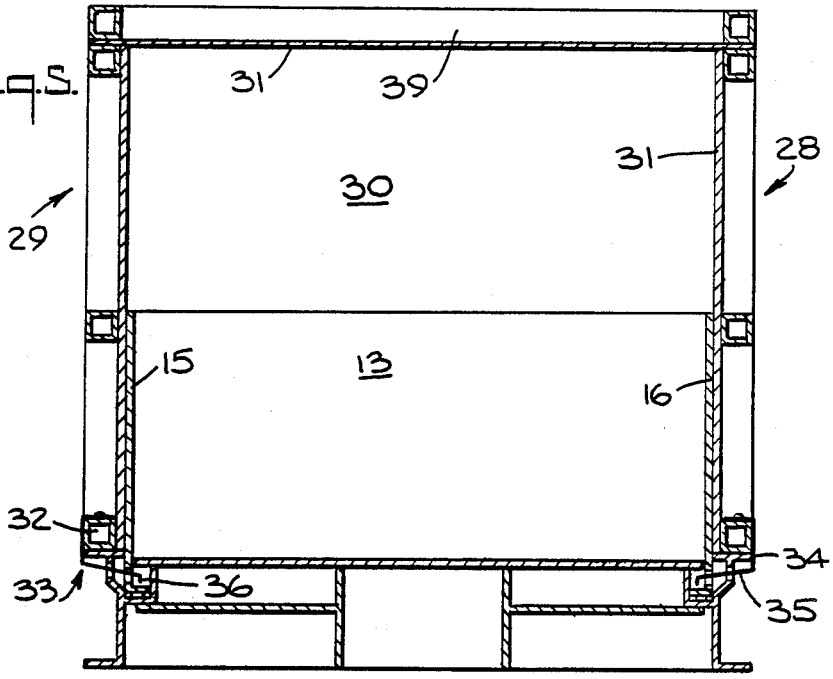
Figure 6:
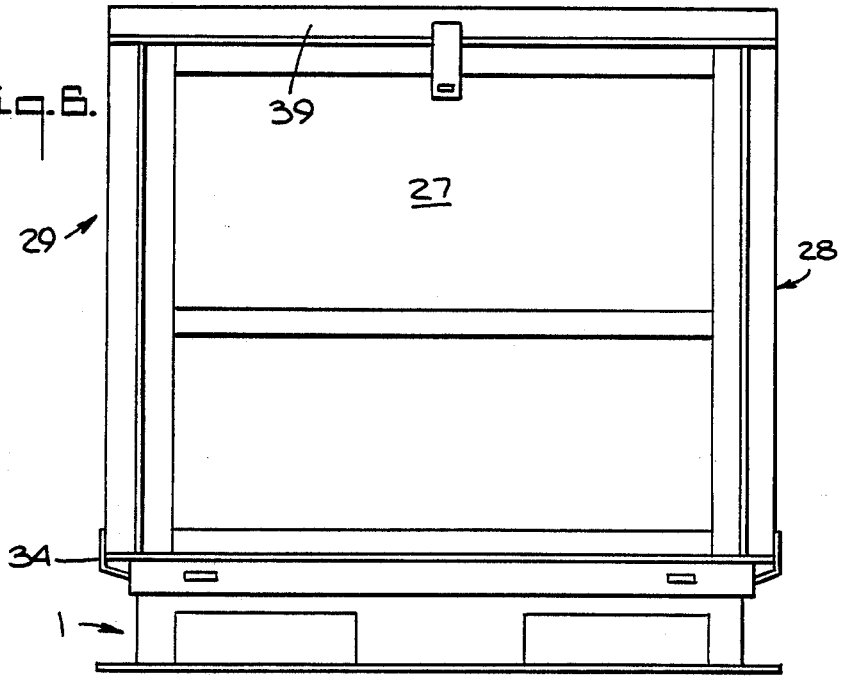
Figure 13:
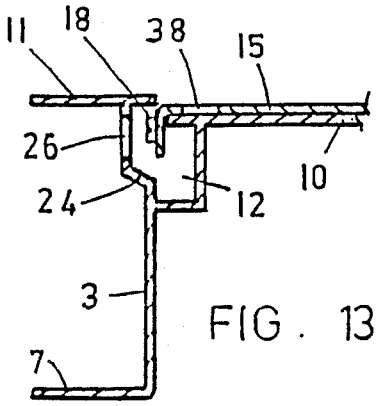
Figure 14:
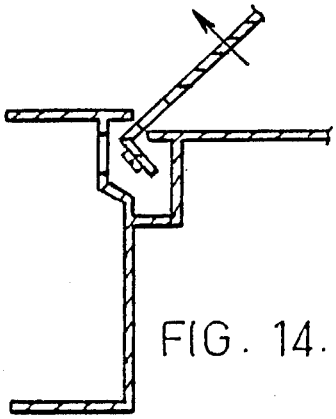
Figure 15:
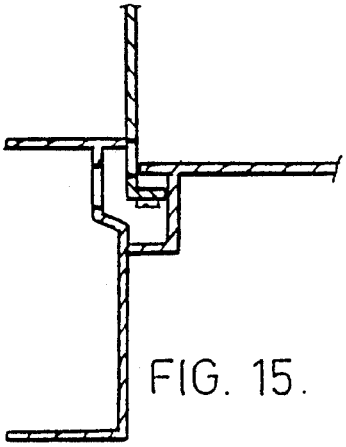
Figure 16:
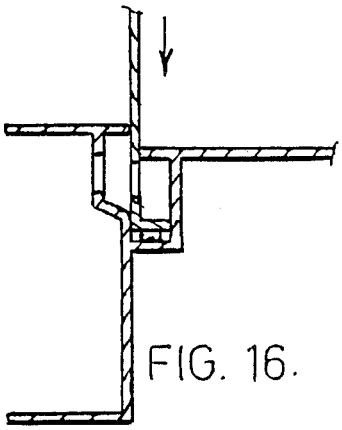
Figure 17:
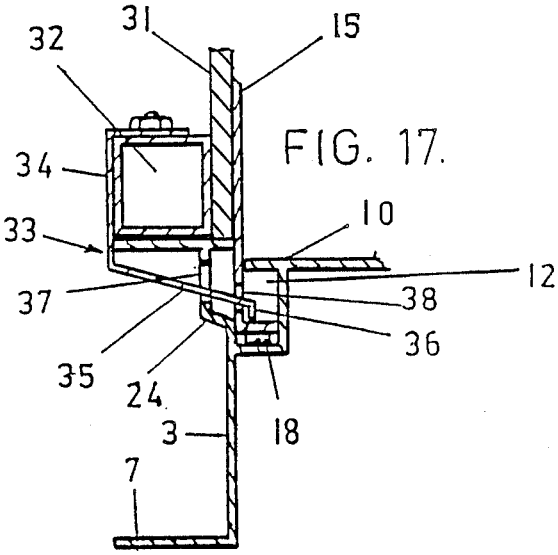

FIG. 4 is a view similar to FIG. 3 of the container base when in a wall erected condition, FIG. 5 is a view similar to FIG. 4 with panels mounted on the container base, FIG. 6 is an elevation of a container comprised of the container base of FIG. 1 and panels and a lid, FIG. 7 is a fragmentary plan view of one form of an interlock arrangement between adjacent edges of wall members of the container base, FIG. 8 is a view similar to FIG. 7 of an alternate form of interlock, FIG. 9 is a perspective view of the interlock of FIG. 7, FIG. 10 is a view similar to FIG. 7 showing a variant of the interlock of FIG. 7, FIG. 11 is a view illustrating the appearance of the FIG. 10 interlock when complete, FIG. 12 is a plan view showing the interlocks between the upright edges of the wall members using the FIG. 7 arrangement, FIG. 13 is an enlarged fragmentary view of portion of the container base and a wall member when in a folded condition, FIG. 14 is a view similar to FIG. 13 showing an initial stage in the erection of the wall member, FIG. 15 illustrates a later stage in the wall member erection and with the wall members upright, FIG. 16 illustrates the locking of the wall member in the erected condition, and FIG. 17 illustrates to an enlarged scale the interconnection of a panel with a container base, The container base as illustrated comprises a base member 1 having sides 2, 3, 4 and 5 with front and rear openings 6 to allow for entry under the base by the tynes of a fork lift or other truck. Around the lower edges of the sides 2 to 5 there is a foot flange 7. FIG. 3 shows additional under members 8 to assist with the support of downloads and lateral members 9 tie the members 8 to the sides 3 and 5.

Around the load supporting surface central portion 10 of the container base there is a peripheral ring-like flange 11. A box section trough 12 is located below a gap 13*a* between the peripheral edge of the surface 10 and the inner perimeter of the flange 11. The form of the trough 12 is best seen in FIG. 13. It is to be noted that the top surface of the flange 11 is at an elevation above the load supporting surface 10.

FIGS. 1, 3, 4 and 12 show the wall members of the container base. There are four wall members identified 13 to 16, each has a height less than half the width of the load supporting surface 20 so they can fold down as shown in FIG. 1 and 3. As illustrated the wall members 15 and 16 lie on top of the load supporting surface 10 an the wall members 13 and 14 overlie the wall members 15 and 16. The manner of erection of the wall members is 15 and 16 first followed by the wall members 13 and 14 which are raised into interlocking engagement with the wall members 15 and 16. The combined thickness of the two layers of wall members when in the folded condition is substantially the same as the height of the flange 11 above the load supporting surface 10.

Each wall member has along an edge which will be lowermost when erected a lip 17 which, when the wall member is in the folded condition is entered into the gap 13*a* and which when the wall member is in the erected condition is entered into the trough 12. The thickness of the lip 17 is such that it will pass through the gap 13*a* to disengage the lip from the base member and it has a width such that when the wall members is erected it will pass into the trough 12. The significance of this can be seen from FIG. 4 and FIGS. 13 to 16.

FIG. 4 shows the wall members erected. There are lugs 18 on the underface of each lip and when the wall members are erected the lugs 18 rest on the bottoms of the troughs 12 with the lips 17 positioned in the troughs and the outer faces of the bodies of the wall members bearing on the inner edges of the flange 11. The wall members are thus anchored at their lowest edges and braced against outward deflection by engagement against the flange 11. The lugs 18, as can be seen from FIGS. 4 and 13 to 16, increase the thickness of the lips 17 to the extent that if removal of a wall member was attempted when in the folded position the lugs would prevent this by engagement on the underface of the flange 11, see FIGS. 3 and 13.

The wall members when erected are interlocked at their adjacent upright edges for strength. Referring to FIG. 7, which is a preferred form of inter-locking, the wall members 13 and 14 have hooks provided by inturned edge flanges 19 and bars 20. The wall members 15 have hook-like arrangements comprised of bars 21 on edge portions 22 of the wall members 15 which are joggled as at 23 relative to the plane of the body of the wall member 15. The interlocking is as shown in FIG. 9. An alternative arrangement is shown in FIG. 8.

FIGS. 10 and 11 illustrate the use of a cap cover 24 on the arrangement as shown in FIG. 9 to ensure there are no plastic bag damaging nip points at the tops of the wall members where they are hooked together. The wall members when so erected and interconnected form a continuous four sided wall system.

FIGS. 13 to 16 illustrate the part rotary and rectilinear movement technique required for the insertion of the wall member lower edges into the troughs 12. In this regard it is to be noted that there is an undercut zone 25 in the outer wall of the trough to accomodate the lip 17 during the operation of tilting the wall members from the folded condition to the erected condition and vice versa. There are holes 26 in the walls of the trough undercut zones to allow access to the abutments 18, in the form of screws, whereby those screws can be inserted during the assembly of the container base and removed when a wall members needs to be removed from the container base.

The purpose of the container base is of course to co-operate with panel members to form a container. Such an assembly is shown in FIGS. 5 and 6 where panels 27 to 30 are shown mounted on the container base. FIGS. 5 and 6 should be read in conjunction with FIG. 17. Each panel 27 to 30 and the lid 39 comprises a metal frame made up of uprights and cross bars with an inner lining of plywood 31. Each panel has a bottom rail 32. The panels 28 and 29 are locking panels and each has a cleat pair 33 fixed to its lower rail 32. The cleats 33 include a downwardly extending portion 34 fixed to the rail 32 which rests upon the top of the flange 11 and an inwardly extending portion 35 with a down turned lug end 36.

The cleat portions 35 pass through apertures 37 in the base sides 3 and 5 and through apertures 38 in the wall members 15 and 16 adjacent the lips 17 thereof. This is best seen in FIG. 17. The cleats serve to hold the panels to the container base and also to prevent the vertical movement of the wall members so engaged, which is a first movement in the disengagement sequence of a wall member from the container base. As will be readily understood the apertures 37 can also serve the same purpose as the holes 26 in the appropriate sides of the base assembly. The other two panels 30 and 31 are hingedly connected upright-to-upright to first uprights of the panels 28 and 19 and the remaining uprights are interlocked by, for example, bolts, so as to form a four sided panel system as is commercially already known.

It is envisaged that the various parts of the container base would be fabricated from metal of suitable gauges. The members 2 to 4 and 8 could be preferably fabricated from a gauge or be constructed in such a manner that in the event a container filled with liquid was dropped the members 2 to 4 and 8 would provide a cushion effect by crumpling in a progressive manner when a predetermined load limit for those members was exceeded.

I claim:

1. A container base assembly, comprising:

a base member including a four-sided perimeter member, a four-sided support surface member disposed within the perimeter member and located in a plane below that occupied by a top edge of the perimeter member with a uniform width gap between the adjacent sides of the support member and the perimeter member;

a stepped width channel below the gap, said channel having a lower part wider than said gap and an upper part wider then said lower part and in communication with said gap; and four substantially rectangular wall members each capable of being received by the gap, each of the wall members being provided with a sliding clearance so that the four wall members are capable of being located one adjacent to each side of the support surface member, the four substantially rectangular wall members each being provided with a thickened first edge having a thickness substantially the same as, but no greater than, the width of the channel lower part, the wall members being foldable into an overlying relationship with the support surface member by positioning the first edge of each wall member in the channel upper part and pivoting the wall inwardly using a side of the support surface member as a fulcrum and being capable of being maintained in an erected position by engagement of the first edge in the channel lower part with lateral support by an inner face of said perimeter member and an outer side of the said support surface member.

2. A container base assembly as claimed in claim 1 wherein the height of said wall members which are positioned in an opposed relationship to one another is less than half of the width of the support surface member between the opposed walls.

3. A container base assembly as claimed in claim 1, wherein side edges of a primary pair of said wall members, said primary pair of wall members being positioned in an opposed relationship to one another, are adjacent to the first edges thereof are of hook profile with terminal portions which are directed towards each other and corresponding side edges of said other two wall members are complementarily hooked so that with the primary pair of wall erected, the side edges thereof will be engaged by the hooked edges of said other two wall members when they are erected.

4. A container base as claimed in claim 1, further comprising openings in a pair of opposed sides of the perimeter member and openings in a pair of said wall members adjacent to the pair of opposed sides and which are aligned with the openings therein when the pair of walls is in an erected position, a four-sided enclosure including two fixing panels and adapted to engage in the openings in the pair of opposed sides of the perimeter member with bottom edges of the fixing panels resting upon the top edge of the perimeter member and to engage in the openings in the pair of walls to prevent the pair of walls from being folded down, hinge means connecting adjacent first corner uprights of the fixing panels and the door panels and catch means to releasably interconnect adjacent second corner uprights of the fixing panels and door panels to form the panels into the four-sided enclosure.

* * * * *